US007294300B2

(12) United States Patent
Wuensch

(10) Patent No.: US 7,294,300 B2
(45) Date of Patent: Nov. 13, 2007

(54) GRINDING PLATE FOR AN ELECTRIC HAND GRINDER, AND METHOD OF PRODUCING THE SAME

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/289,802

(22) Filed: Nov. 30, 2005

(65) Prior Publication Data

US 2006/0079161 A1 Apr. 13, 2006

Related U.S. Application Data

(62) Division of application No. 10/684,551, filed on Oct. 14, 2003, now abandoned.

(30) Foreign Application Priority Data

Oct. 14, 2002 (DE) ..... 102 47 899

(51) Int. Cl.
*B24B 9/20* (2006.01)

(52) U.S. Cl. ..... 264/163; 451/344; 264/162

(58) Field of Classification Search ..... 264/163
See application file for complete search history.

(56) References Cited

U.S. PATENT DOCUMENTS 2,988,835 A * 6/1961 Murphy ..... 40/615
3,595,111 A * 7/1971 Hershberger ..... 83/19
5,626,510 A * 5/1997 Bergner et al. ..... 451/357
6,443,825 B2 * 9/2002 Schadoffsky et al. ..... 451/344
2001/0055944 A1 * 12/2001 Moolenaar et al. ..... 451/357
2002/0197940 A1 * 12/2002 Catalfamo ..... 451/344

* cited by examiner

*Primary Examiner*—Christina Johnson
*Assistant Examiner*—Keith J. Godfrey
(74) *Attorney, Agent, or Firm*—Michael J. Striker

(57) ABSTRACT

A grinding plate for an electric hand grinder has a plate member having an upper plate surface with an upper plate edge, a lower plate surface with a lower plate edge for placement of a grinding means and extending at least partially beyond the upper plate edge, and a side surface extending from the upper plate edge to the lower plate edge, and having a pagoda-shaped contour in a projecting region of the lower plate edge and the grinding plate is produced by a method including punching out the plate body with the upper surface, the lower surface and the side surface from an elastic material in a desired shape; placing a round bar on the upper plate surface along the upper plate edge of the plate body with a parallel distance from it; pressing the round bar into the plate body so that an elastic material of the plate body is squeezed outwardly under the round bar; separating the squeezed out material along an outer edge of the round bar with a separating cut extending perpendicular to the plate surfaces; and removing the round bar from the upper plate surface.

2 Claims, 3 Drawing Sheets

GRINDING PLATE FOR AN ELECTRIC HAND GRINDER, AND METHOD OF PRODUCING THE SAME

BACKGROUND OF THE INVENTION

This application is a division of U.S. application Ser. No. 10/684,551, filed Oct. 14, 2003 now abondoned, the disclosure of which is incorporated herein by reference.

The present invention relates to a grinding plate composed of an elastic material for an electric hand grinder, and also to a method for producing the same.

A known electric hand grinder formed for example as a vibration grinder or an eccentric grinder (DE 35 10 333 A1) has a grinding medium support composed of a driven, rigid support part and an elastic grinding plate which is fixed with an upper plate surface on the support part. Its lower plate surface is provided with a receptacle of a grinding means, for example a grinding plate or a grinding disc. For obtaining a high grinding yield, the grinding plate has a predetermined Shore hardness. Such a grinding plate is produced in a cost-favorable manner by punching out of a large-surface sheet and glueing to the support part.

During the punching process it is however only possible to carry out cuts which are perpendicular to the grinding plate, so that the grinding plate has a side surface extending at the right angle to the plate plane and connects the upper plate edge with the lower plate edge. In high-grade electric hand grinders the side surface of the grinding plate which extends from the upper plate edge to the lower plate edge is inclined to the upper plate edge so that it has a substantially trapeze-shaped cross-section (DE 298 11 654 U1). Because of the extension of the lower plate edge, a good edge accessibility of the grinding plate is provided, so that a workpiece can be exactly ground in corners or edges without producing abrasion traces due to striking of the grinding plate carrier against the end side of the workpiece. Such abrasion traces are difficult to remove, in particular on bright surfaces. Also, damages to the workpieces are avoided, which can be caused by excessive pressing of the grinding plate into the edges to be ground.

Such grinding plates with the projecting lower grinding plate edge are produced by injection molding process from polyurethane or integral foams. These foam processes are however relatively expensive.

SUMMARY OF THE INVENTION

Accordingly, it is an object of the present invention to provide a grinding plate for an electric hand grinder, and method of producing the same, which avoid the disadvantages of the prior art.

In keeping with these objects and with others which will become apparent herein after, one feature of the present invention resides, briefly stated, in a grinding plate for an electric hand grinder, comprising a plate member having an upper plate surface with an upper plate edge, a lower plate surface with a lower plate edge for placement of a grinding means and extending at least partially beyond said upper plate edge, and a side surface extending from said upper plate edge to said lower plate edge, said side surface in a projecting region of said lower plate edge having a pagoda-shaped contour.

When the grinding plate is designed in accordance with the present invention, it has the advantage that the shape of the side surface of the grinding plate extending outwardly to the lower plate edge can produce a grinding edge lip with a great yielding ability of the grinding edge. Thereby grinding operations can be performed finely and exactly both on visible and also on covered edges of the workpiece. The yielding ability of the grinding edge lip also allows grinding of transitions, in particular also in a radius region. A staining of the plate material onto the workpiece as well as damages of workpiece walls are substantially excluded, since the upper plate edge and thereby the support of the electric hand grinder which receives the grinding plate is dimensionally set back and the support thereby does not bump against the workpiece.

In accordance with a further features of the present invention the upper and lower plate surfaces have a rectangular shape and the lower plate surface extends over the upper plate surface at both sides selected from the group consisting of both long sides, both short sides, and both long sides and both short sides of a rectangle, the upper and lower plate surfaces have a circular shape and the upper plate surface extending circumferentially beyond the upper plate surface, the plate edges of the upper and lower plate surfaces are joined to a tip located on a central axis of the plate surface and the lower plate surface extends all around beyond the upper plate surface.

In accordance with a preferable embodiment of the invention, the grinding plate can have a rectangular shape, a cross shape, a triangular shape or a shape similar to the plate surface of a pressing iron. In the first case the lower plate surface projects beyond the upper plate surface at both longer sides, or at both shorter sides, or at all sides of the rectangle. In other cases, the lower plate surface extends all around beyond the upper plate surface. In all cases the side surface in the projecting region has a pagoda-shape contour.

It is another feature of the present invention to provide a method of producing a grinding platecomprising the steps of punching out a plate body with an upper surface, a lower surface and a side surface from an elastic material in a desired shape; placing a round bar on the upper plate surface along an upper plate edge of the plate body with a parallel distance from it; pressing the round bar into the plate body so that an elastic material of the plate body is squeezed outwardly under the round bar; separating the squeezed out material along an outer edge of the round bar with a separating cut extending perpendicular to the plate surfaces; and removing the round bar from the upper plate surface.

When the method is performed in accordance with the present invention, it has the advantage of a simple and cost-favorable manufacture of the grinding plate by simple punching processes, without using relatively expensive foaming processes. As in the case of the grinding plates for so-called expensive grinding devices with side surfaces extending perpendicular to the grinding plate plane, the expensive plate articles which are used for this grinding plate can be further utilized, and from them grinding plates for high-grade grinding works can be produced by the simple punching process.

In accordance with a further feature of the present invention the separating cut is carried out at a predetermined distance from an outer edge of the round bar.

In accordance with still a further feature of the present invention, a material of a grinding plate, a material thickness, a plate thickness of the plate body, a round bar diameter, a penetration depth of the round bar into the plate body and/or a distance of the separating cut from the outer edge of the round bar are selected in correspondence with a desired course of the pagoda-shaped contour.

In accordance with still another feature of the present invention invention, a material of the grinding plate is a cellular rubber, and the plate thickness is approximately 8 mm, the round bar diameter is approximately 10 mm, the penetration depth of the round bar into the plate body is approximately 5 mm, and the distance is a separating line from the outer edge of the round bar of approximately 2 mm.

In accordance with still a further feature of the present invention the separating cut is carried out by a punching cutter.

In accordance with still another feature of the present invention for producing a circular ring-shaped grinding plate with circumferential plate edges, a circular ring-shaped round bar is used, which is placed at a radial distance relative to the upwardly surrounding plate edge on the upper plate surface of the grinding body.

In a preferable embodiment of the invention, a cellular rubber can be selected as a material for the grinding plate and with a plate thickness of approximately 8 mm, the round bar diameter is approximately 10 mm, the penetration depth of the round bar is approximately 5 mm, and the distance of the separating cut from the round bar outer edge is approximately 2 mm.

The separating cut can be advantageously carried out by a punching tool.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
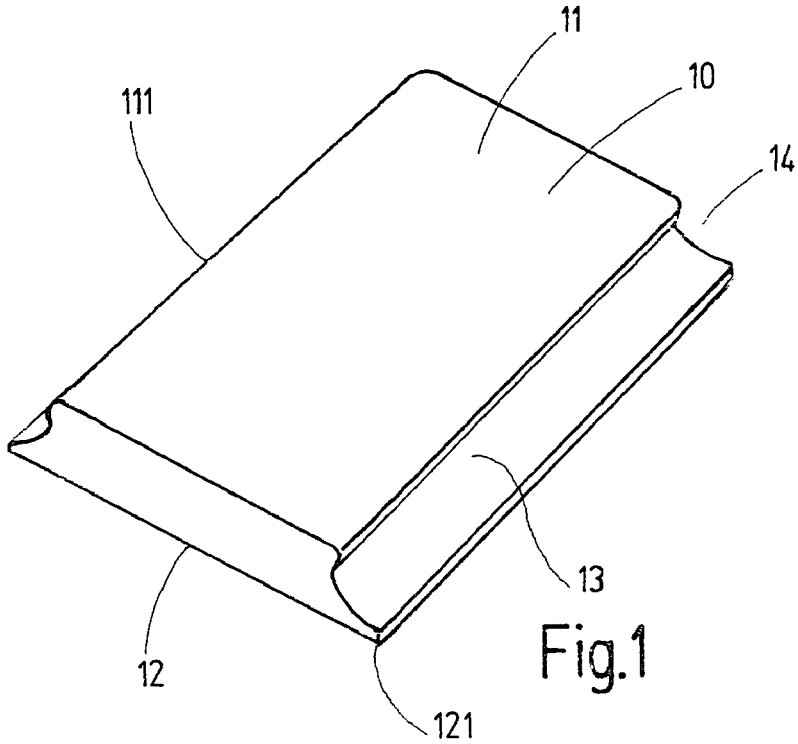
FIG. 1 is a perspective view of a grinding plate for a vibration (orbital) grinder in accordance with the present invention.

A grinding plate for a vibration grinder is shown in perspective in FIG. 1 as an example for a general electric hand grinder. It has a rectangular plate body 10 composed of an elastic material and having an upper plane surface 11 placeable on a support of the vibration grinder, a lower plate surface 12 covered with a grinding means, for example a grinding plate or a grinding disc and side surfaces 13 extending from the upper plate edge 111 to the lower plate edge 121.

The lower plate surface 12 projects substantially far beyond the both longitudinal edges of the upper plate edge 11. The both side surfaces 13 which extend from the both longitudinal edges of the upper plate edge 111 correspondingly to the both longitudinal edges of the lower plate edge 121 each have a pagoda-shaped contour 14. Thereby in the region of the longitudinal edges on the lower plate edge 121, an elastic grinding edge lip is produced, which is displaced forwardly relative to the plate body 10 at a distance.

Corner edges on the workpiece can be ground very well with this elastic grinding edge lip. Also, such regions of the workpiece can be ground which are offset back behind a visible edge. Due to the great lateral extension distance of the lower plate edge 121 beyond the upper plate edge 111, the support which receives the grinding plate can not bump against the end side of the workpiece, so that both damages can be avoided and also abrasion traces of the support on the workpiece can be prevented. It is to be understood that also the both small side surfaces on the plate body 10 can be provided with such a pagoda-shaped contour 14.

Figure 2:
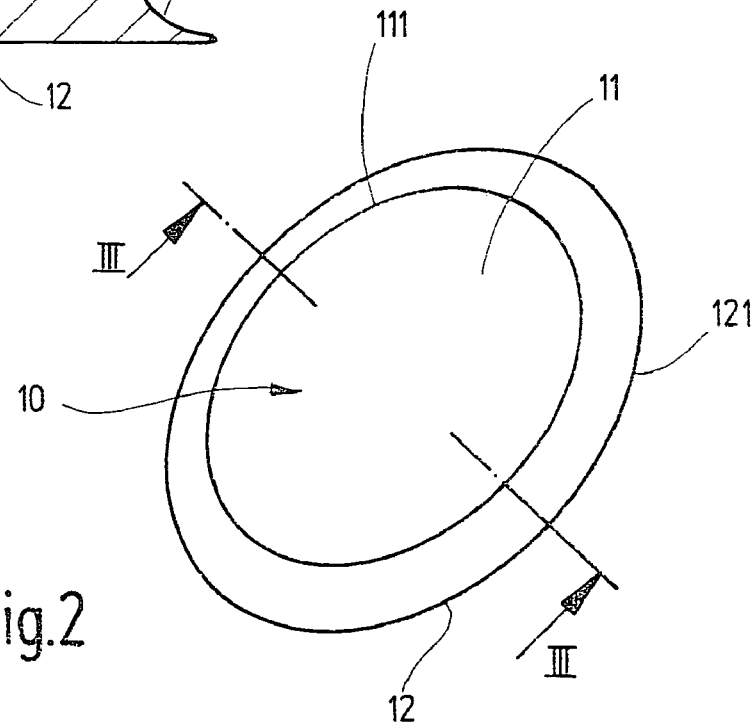
FIG. 2 is a perspective view of a grinding plate for an eccentric grinder in accordance with the present invention.

The grinding plate shown in a perspective plan view in FIG. 2, also known as a grinding disc, for an eccentric grinder has a circular plate body 10, wherein the lower plate surface 12 extends all around beyond the upper plate surface 11. As can be seen from FIG. 3, the upper plate edge 111 has a circumferential side surface 13 which is connected with the lower plate edge 121 and also has a pagoda-shaped contour 14.

Figure 4:
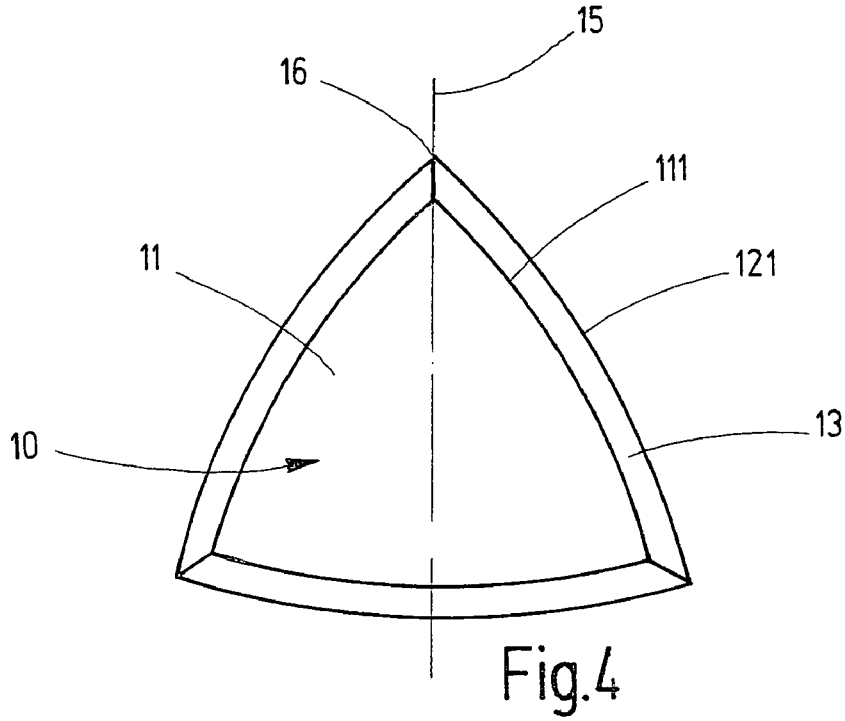
FIG. 4 is a plan view of a grinding plate for a triangular grinder.

The grinding plate for a so-called triangular grinder, which is shown in an plan view in FIG. 4 has a triangular plate body 10 with slightly curved plate edges 111, 121 extending from one triangle tip to another triangle tip. The triangle can be unilateral or isosceles, so that at least one tip 16 of the triangular tips is located on the central axis 15 of the grinding plate or the plate body 10. The lower plate surface 12 extends beyond and around the upper plate surface 11, and the side surface 13 which connects the upper plate edge 111 with the lower plate edge 121 has the above described pagoda-shaped contour.

Figure 5:
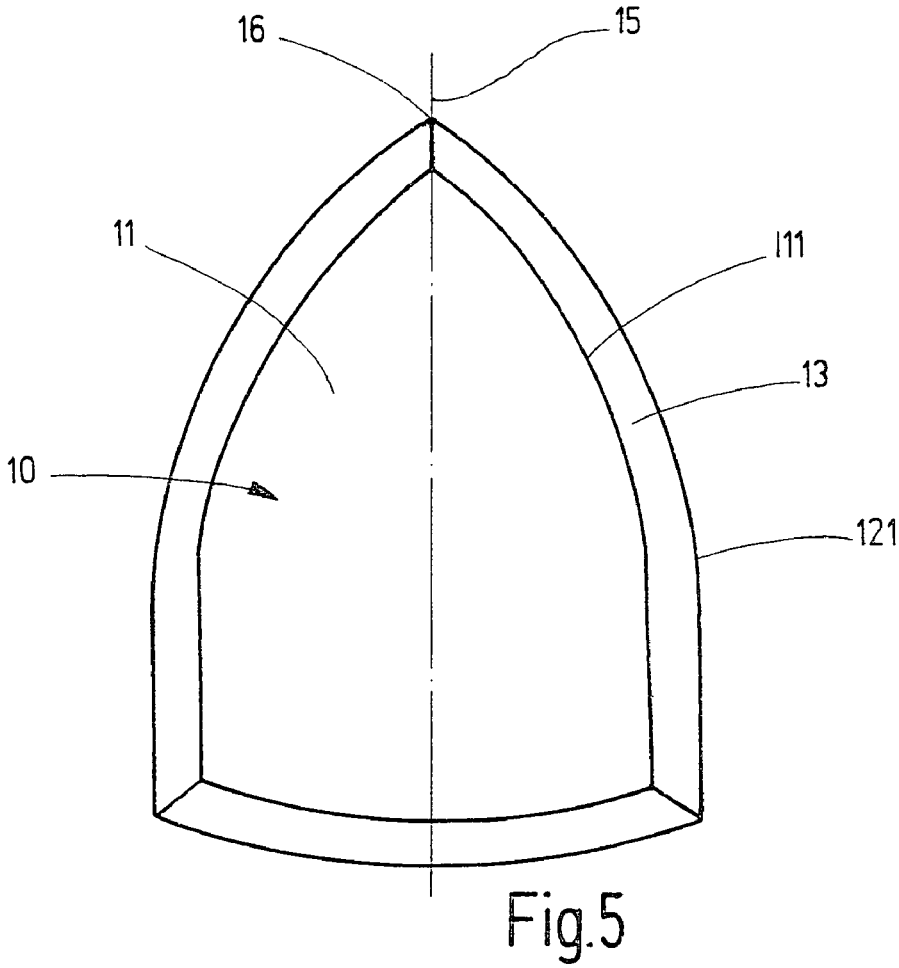
FIG. 5 is a plan view of a modified grinding plate for a vibration grinder.

In the grinding plate for a vibration grinder which is modified and shown in FIG. 5 on a plan view, the portions of the upper and lower plate edges 111 and 121 of the plate body 10 extending in the longitudinal direction of the grinding plate are guided in a working direction of the grinding plate forwardly of the central axis 15 of the grinding plate to a tip 16. In the lower region the portions extend parallel to one another and abut against the slightly curved portion of the plate edges 111, 121 extending transversely to the central axis 15 so that the plate body 10 has a pressing iron shape. The lower plate surface 12 extends the upper plate surface 11, and the side surface 13 has a positive-shaped contour around.

Figure 6A:
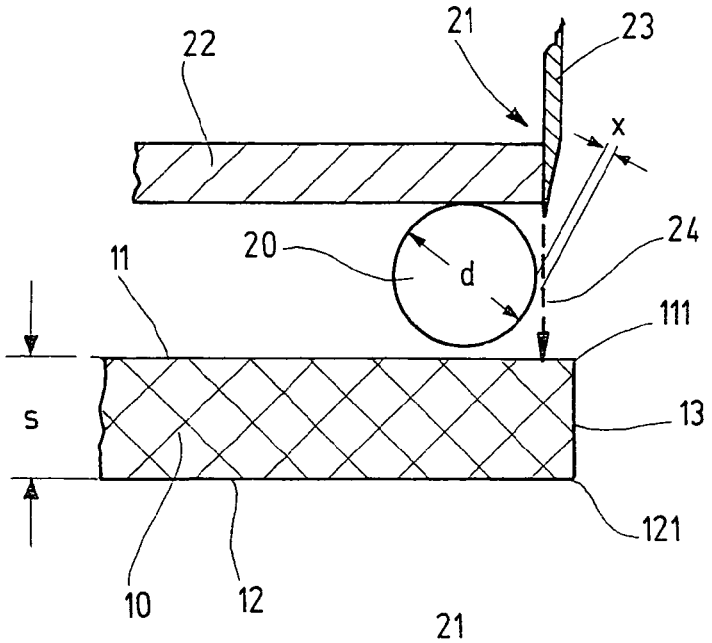
FIG. 6 is a view showing a section of a grinding plate shown in FIGS. 1 or 2.

The production of the grinding plate of FIG. 1 is illustrated in FIG. 6 in three method steps. In the grinding plate, a region of the plate body 10 located near the longitudinal edges of the upper and lower right plate edges 111, 121 with the side surface 13 connecting the plate edges is illustrated. The method for producing the grinding plate is performed in the following manner:

The plate body 10 for the grinding plate with the plate thickness s is punched out from an elastic material in the desired rectangular shape in the shown example. The elastic material which is used for this purpose is for example a cellular rubber which is supplied in large-surface plates. Such a punching out of the plate body from a large-surface plate material is known, and as a result, a grinding plate is produced with flush upper and lower plate edges 13 and with side surfaces 13 extending perpendicular to the plate surfaces 11 and 12.

Figure 6B:
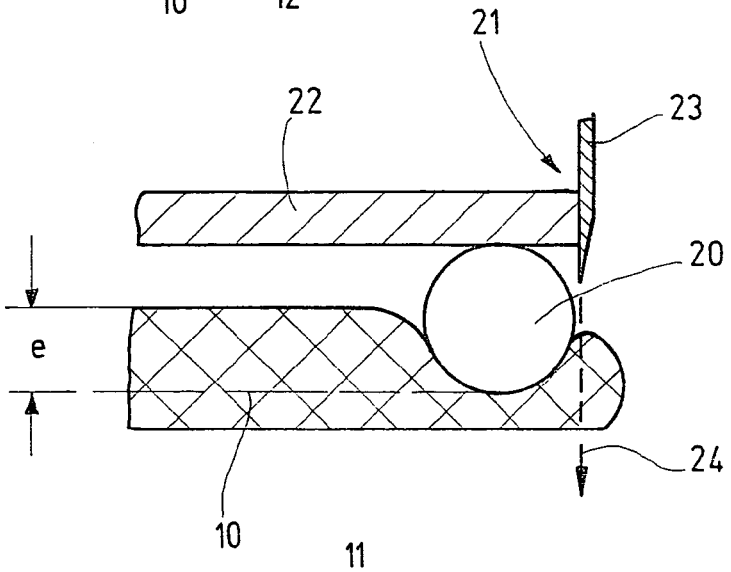
Figure 6C:
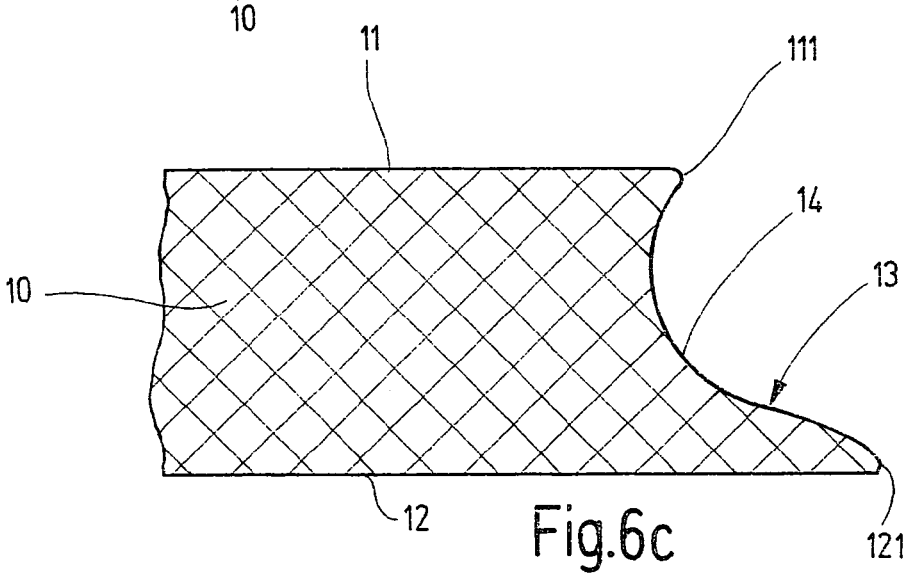

As shown in FIG. 6, a round bar is placed on the upper plate surface 11 of the punched out plate body 10, and extends at a distance from the upper plate edge 11, 111 over the whole length of the plate body 10. By means of a punching tool 21, which includes a pressing plate 22 and a punching cutter 23, the round bar 20 is pressed with a predetermined penetration depth e into the plate body 10, and the elastic material of the plate body 10 under the round bar 20 is squeezed outwardly as shown in FIG. 6*b*. The squeezed edge material is separated by the punching cutter 23 along the outer edge of the round part 20, with a separating cut 24 which extends perpendicular to the plate surface 11, 12. When the punching tool 21 is lifted, the round bar 20 is again released and removed from the upper plate surface 11. The elastic material moves back due to the unloading, and the side surface 13 assumes its pagoda-shaped contour as shown in FIG. 6*c*. The separating cut 24 is therefore set at a predetermined distance x from the outer edge of the round part 20. The geometry of the pagoda-shaped contour 14 can be influenced by the selection of the plate tool, the density of the plate material, the plate thickness s of the grinding plate, the diameter d of the round bar 20, the penetration depth e of the round bar 20 in the plate body 10, and by the distance x of the punching cutter 23 or the separating cut 24 to the outer edge of the round bar 20.

In the first embodiment for carrying out the inventive method, cellular rubber is selected as a plate material, and the plate body 10 is punched out for the grinding plate with a plate thickness s of 8 mm. There are selected: the round bar diameter d is 10 mm, the penetration depth of the round bar 20 in the plate body 20 is 5 mm, and the distance x of the separating cutter 23 from the round bar outer edge is approximately 2 mm. With these dimensions, the contour of the side surface 13 shown in FIG. 6*c* on an enlarged scale is produced.

Figure 3:
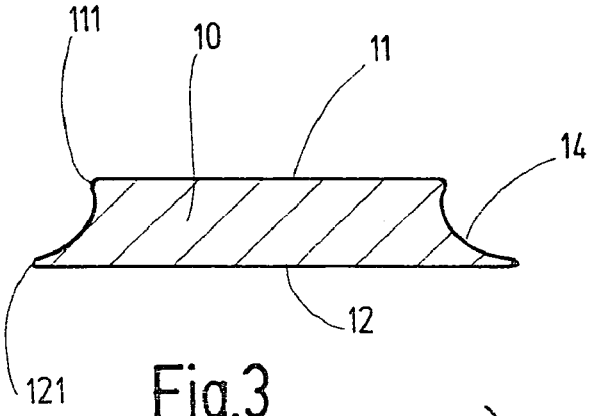
FIG. 3 is a view showing a section taken along the line 111-111 in FIG. 2.

For producing the circular grinding plate shown in FIGS. 2 and 3, the same method is utilized as described herein above. The only difference is that the round bar 20 which is placed on the upper plate surface 11 of the punched out plate body 10 has a circular ring shape. Also, here the round bar 20 is arranged with a correspondingly selected distance from the circumferential outer plate edge 111, and pressed into the grinding body 10. The manufacturing processes steps are identical as described herein above. The production of the triangular or pressing iron-shaped grinding plate in FIGS. 4 or 5 is performed in an equivalent manner.

It will be understood that each of the elements described above, or two or more together, may also find a useful application in other types of methods and constructions differing from the types described above.

While the invention has been illustrated and described as embodied in grinding plate for an electric hand grinder, and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method of producing a grinding plate which has a plate member having an upper plate surface with an upper plate edge, a lower plate surface with a lower plate edge for placement of a grinding means and extending at least partially beyond said upper plate edge, and a side surface extending from said upper plate edge to said lower plate edge and having in a projecting region of said lower plate edge a pagoda-shaped concave contour, the method comprising the steps of:

selecting a material of a grinding plate, a material thickness, a plate thickness of the plate body, a round bar diameter, a penetration depth of the round bar into the plate body and/or a distance of the separating cut from the outer edge of the round bar in correspondence with a desired course of the pagoda-shaped contour;

punching out the plate body with the upper surface, the lower surface and the side surface from an elastic material in a desired shape;

placing a round bar on the upper plate surface along the upper plate edge of the plate body with a parallel distance from it;

pressing the round bar into the plate body so that an elastic material of the plate body is squeezed outwardly under the round bar;

separating the squeezed out material along an outer edge of the round bar with a separating cut extending perpendicular to the plate surfaces at a predetermined distance from an outer edge of the round bar and;

removing the round bar from the upper plate surface; and further comprising with a cellular rubber as a material of the grinding plate, and a plate thickness of approximately 8 mm, selecting a round bar diameter of approximately 10 mm, a penetration depth of the round bar into the plate body of approximately 5 mm, and a distance of a separating line from the outer edge of the round bar of approximately 2 mm.

2. A method as defined in claim 1; and further comprising, for producing a circular ring-shaped grinding plate with circumferential plate edges, using a circular ring-shaped round bar which is placed at a radial distance relative to the upper plate edge on the upper plate surface of the grinding body.

* * * * *